US007073229B2

(12) United States Patent
Breuer et al.

(10) Patent No.: US 7,073,229 B2
(45) Date of Patent: Jul. 11, 2006

(54) APPARATUS ON A CARDING MACHINE FOR TEXTILE FIBRES, FOR EXAMPLE, COTTON, SYNTHETIC FIBRES OR THE LIKE, COMPRISING REVOLVING CARD FLAT BARS EQUIPPED WITH CLOTHING

(75) Inventors: Achim Breuer, Aachen (DE); Christoph Färber, Korschenbroich (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 23 days.

(21) Appl. No.: 10/830,138

(22) Filed: Apr. 23, 2004

(65) Prior Publication Data

US 2004/0211037 A1 Oct. 28, 2004

(30) Foreign Application Priority Data

Apr. 26, 2003 (DE) ..... 103 18 966

(51) Int. Cl.
*D01G 15/02* (2006.01)

(52) U.S. Cl. ..... 19/102

(58) Field of Classification Search ..... 19/65 R, 19/98, 102, 103, 105, 111, 200, 204
See application file for complete search history.

(56) References Cited

U.S. PATENT DOCUMENTS 638,111 A 11/1899 Gillett et al.
5,918,349 A * 7/1999 Leifeld et al. ..... 19/103
6,047,446 A * 4/2000 Leder et al. ..... 19/102
6,408,488 B1 * 6/2002 Leder et al. ..... 19/114
6,691,373 B1 * 2/2004 Leder ..... 19/98

FOREIGN PATENT DOCUMENTS

| | | |
|---|---|---|
| DE | 43 04 148 | 11/1993 |
| DE | 94 14 450 | 12/1994 |
| DE | 101 05 855 | 8/2002 |
| GB | 2 340 509 A | 2/2000 |
| GB | 2 372 045 A | 8/2002 |
| WO | WO 00/05441 | 2/2000 |

* cited by examiner

*Primary Examiner*—Gary L. Welch
(74) *Attorney, Agent, or Firm*—Venable LLP; Robert Kinberg; Edward W. Yee

(57) ABSTRACT

In an apparatus on a carding machine for textile fibres, for example, cotton, synthetic fibres and the like, comprising revolving card flat bars equipped with clothing, in which a space is present between the tips of the card flat clothings and the tips of the cylinder clothing and the card flat clothings form an adjustable angle with the cylinder clothing, the ends of the card-flat bars each slide with one part on a first curved slideway and with another part on a second curved slideway and the sliding-contact surfaces of the slideways—viewed circumferentially—are different distances from one another.

To produce an apparatus that is structurally simple and easy to assemble, enables the carding intensity of the card flat bars to be individually adjusted and allows wear of the clothing of the card flat bars to be reduced, the sliding-contact surfaces are arranged so that the distances between the sliding-contact surfaces both increase and decrease.

21 Claims, 7 Drawing Sheets

A-A

B-B

C-C

APPARATUS ON A CARDING MACHINE FOR TEXTILE FIBRES, FOR EXAMPLE, COTTON, SYNTHETIC FIBRES OR THE LIKE, COMPRISING REVOLVING CARD FLAT BARS EQUIPPED WITH CLOTHING

CROSS REFERENCE TO RELATED APPLICATION

This application claims priority from German Patent Application No. 10318966.1 dated 26 Apr. 2003 the disclosure of which is incorporated herein by relevance.

BACKGROUND OF THE INVENTION

The invention relates to an apparatus on a carding machine for textile fibres, for example, cotton, synthetic fibres and the like, comprising revolving card flat bars equipped with clothing.

In certain known revolving card flat assemblies a space is present between the tips of the card flat clothings and the tips of the cylinder clothing and the card flat clothings form an adjustable angle with the cylinder clothing, wherein the ends of the card flat bars each slide with one part on a first curved slideway and with another part on a second curved slideway and the sliding-contact surfaces of the slideways—viewed circumferentially—have different distances from one another.

In a known apparatus (WO 00/05441), an adjusting device for the local displacement of the flexible second slideway is arranged centrally. On operation thereof, the second slideway is moved outwards or inwards in a radial direction with respect to the cylinder. The adjusting device includes a plurality of support members, which extend from a central support member and support the second curved slide such that the radial support members extend or contract in response to the position of the adjusting device. The adjusting device can operate hydraulically or pneumatically. The second guide means can be arranged in the operating region of the cylinder substantially parallel to the cylinder surface; alternatively, its relative position may vary around the working surface of the cylinder, in order to change the angle of inclination of the card flats as they traverse the working region of the cylinder and hence to influence the quality of carding obtained. It is not necessary to adjust each card flat bar individually; all that is required is a single adjustment of the position of the guide means with respect to the carding machine in order to set the angle of inclination of all card flat bars in the flat driving chain. The high structural complexity required for displacing and adjusting the card flat bars is a disadvantage. The known apparatus is costly in terms of equipment. It is a further disadvantage that the support members are only in point-contact engagement with the second slideway. In particular, it is inconvenient that the angles of inclination of all the card flat bars at any one time are adjustable. In this way, either all angles of inclination can only be increased or all angles of inclination can only be decreased. This uniform alignment of the card flat bars, or rather, of the card flat bar clothings, can lead to increased damage to the fibres and to nep formation. Finally, the clothings of the card flat bars are subject to considerable wear during operation.

It is an aim of the invention to provide an apparatus of the kind described in the introduction, which avoids or mitigates the said disadvantages, which in particular is of simple construction and is easy to assemble, enables the carding intensity of the card flat bars to be more flexibly adjusted and allows wear of the clothing on the card flat bars to be reduced.

SUMMARY OF THE INVENTION

The invention provides a carding machine comprising a carding cylinder and a revolving card flat assembly comprising revolving card flat bars, the machine further having a lateral slideway assembly comprising a first curved slideway and a second curved slideway and upon which ends of the card top bars can slide with a part on said first slideway and a part on said second slideway, wherein said first slideway has a first sliding-contact surface and said second slideway has a second sliding-contact surface which is so located relative to the first sliding-contact surface that there is at least a first portion of said slideway assembly in which a distance in the vertical direction between the first and second sliding-contact surfaces increases and a second portion of said slideway assembly in which said distance decreases.

The features according to the invention permit the angle between the clothing surface of each card flat bar and the cylinder clothing—the so-called offset angle—to be individually selected. A particular advantage comprises the fact that by specific or individual alignment of the clothing surfaces of the card flat bars in relation to one another, the ratio of fibre damage to nep formation can be quite considerably improved. Added to this is that the fact that the lasting technological improvement is rendered possible in a structurally especially simple way. The arrangement of the slideways enables additional devices for displacing the card flat bars and the slideways to be omitted. The individual adjustment of the angle of inclination is effected automatically by virtue of the fact that the sliding elements of the card flat bars slide on two sliding-contact surfaces, the mutual spacings of which both increase and decrease. In accordance with a further advantage, the individual inclination of the carding surfaces considerably reduces wear of the clothing on the card flat bars.

Advantageously, the distances of the sliding-contact surfaces of the slideways with respect to the cylinder clothing both increase and decrease.

Advantageously, the distances of the sliding-contact surfaces of the slideways do not become strictly monotonously smaller or larger with respect to one another. Advantageously, the slideways are arranged side by side on each of the carding machine. The second slideway may be integrated in the first slideway. The slideways may be of one-piece construction. The slideways may be arranged separately side by side.

Advantageously, two sliding elements are present on each card flat bar end, the sliding elements being of different cross-section and/or diameter.

Advantageously, in the end region of a respective sliding element there is arranged a cylindrical element, a disc or the like, which has a larger diameter than the respective other sliding element. Advantageously, at least one slideway is flexible. Advantageously, at least one slideway—in relation to the cylinder—is constructed to be displaceable in the circumferential direction.

Advantageously, at least one slideway is of wedge-form construction. Advantageously, the card flat bars are arranged so as to rotate about an axis of rotation parallel to the cylinder axis.

Advantageously, the axis of rotation is arranged in the middle of each card flat bar.

Advantageously, the angle between the carding surface of at least one card flat bar and a respective tangent to the clothing of the cylinder is adjustable. Advantageously, the angle between the carding surface of at least one card flat bar and a respective radius of the cylinder is individually adjustable. Advantageously, at least one carding nip closes (offset angle) at the fibre inlet, viewed in the direction of rotation of the cylinder. Advantageously, at the fibre outlet at least one carding nip opens (counter-offset angle), viewed in the direction of rotation of the cylinder. Advantageously, between fibre inlet and fibre outlet at least one angle amounts to 0°. A*dvantageously*, the card flat bar automatically assumes different offset positions as it traverses the working region from card flat inlet to card flat *exit*. A*dvantageously*, the different sliding *elements*, *e.g.* slide *pins*, of each card flat bar run on two *sliding-contact* surfaces (*slide rails*) of different heights relative to one *another*. A*dvantageously*, the different diameters of the sliding region of the sliding elements cause an offset *angle*, no offset angle and a *counter-offset* angle of the card flat bar during a traverse *thereof*. A*dvantageously*, the sliding *elements*, for *example*, slide *pins*, are fixed at the same height to the card flat *bar*. A*dvantageously*, the sliding *elements*, for *example*, slide *pins*, are not fixed at the same height to the card flat *bar*.

Advantageously, the height gradient between the two slide rails has an arbitrary contour (sliding-contact surface). Advantageously, at least one slide rail is exchangeable for another slide rail having a different contour (sliding-contact surface). Advantageously, the two slide rails are each separately displaceable relative to one another on one side of the cylinder.

Advantageously, displacement of the slide rails is effected during continuous operation.

Advantageously, as the card flat bars are being guided over the working region a different offset angle is set independently of location.

Advantageously, two slide rail tracks are present and each sliding element, for example, card flat bar guide pin, moves on its own slide rail guide track. Advantageously, a slide rail with two different slide tracks is present on each side of the cylinder. Advantageously, the change in the offset angle is caused by an offset in height of the slide tracks relative to one another.

Advantageously, the offset in height over the path of the revolving card flat assembly is independent of location. Advantageously, the offset in height over the path of the revolving card flat assembly is freely selectable. Advantageously, the offset in height over the path of the revolving card flat assembly has offsets in continuity, for example, of a sharp-edge nature. Advantageously, the slide tracks over the path of the revolving card flat assembly, that is to say, the height offset, are unvarying. Advantageously, the slide tracks over the path of the revolving card flat assembly, that is to say, the height offset, are produced by material-removing machines. Advantageously, the sliding-contact surfaces cross one another, viewed in the lateral direction. Advantageously, at the intersection point of the sliding-contact surfaces there is, viewed in the lateral direction, no distance in the vertical direction between the sliding contact surfaces.

The invention also provides an apparatus on a carding machine for textile fibres, for example, cotton, synthetic fibres and the like, comprising revolving card flat bars equipped with clothing, in which a space is present between the tips of the card flat clothing and the tips of the cylinder clothing and the card flat clothings form an adjustable angle with cylinder clothing, wherein the ends of the card flat bars each slide with one part on a first curved slideway and with another part on a second curved slideway and the sliding-contact surfaces of the slideways—viewed circumferentially—are different distances from one another, wherein the sliding-contact surfaces of the slideways are arranged so that the distances in the vertical direction between the sliding contact surface both increase and decrease.

The invention also provides a carding machine comprising a carding cylinder and a revolving card flat assembly comprising revolving card flat bars, the machine further having a lateral slideway assembly comprising a first curved slideway and a second curved slideway and upon which the card flat bars can slide with a first end part on said first slideway and a second end part on said second slideway, wherein said first slideway has a first sliding-contact surface and said second slideway has a second sliding-contact surface which is so located relative to the first sliding-contact surface that there are at least a convergent portion and a divergent portion of said slideway assembly in which in the vertical direction said first and second sliding-contact surfaces respectively converge and diverge.

DESCRIPTION OF THE PREFERRED EMBODIMENTS

Figure 1:
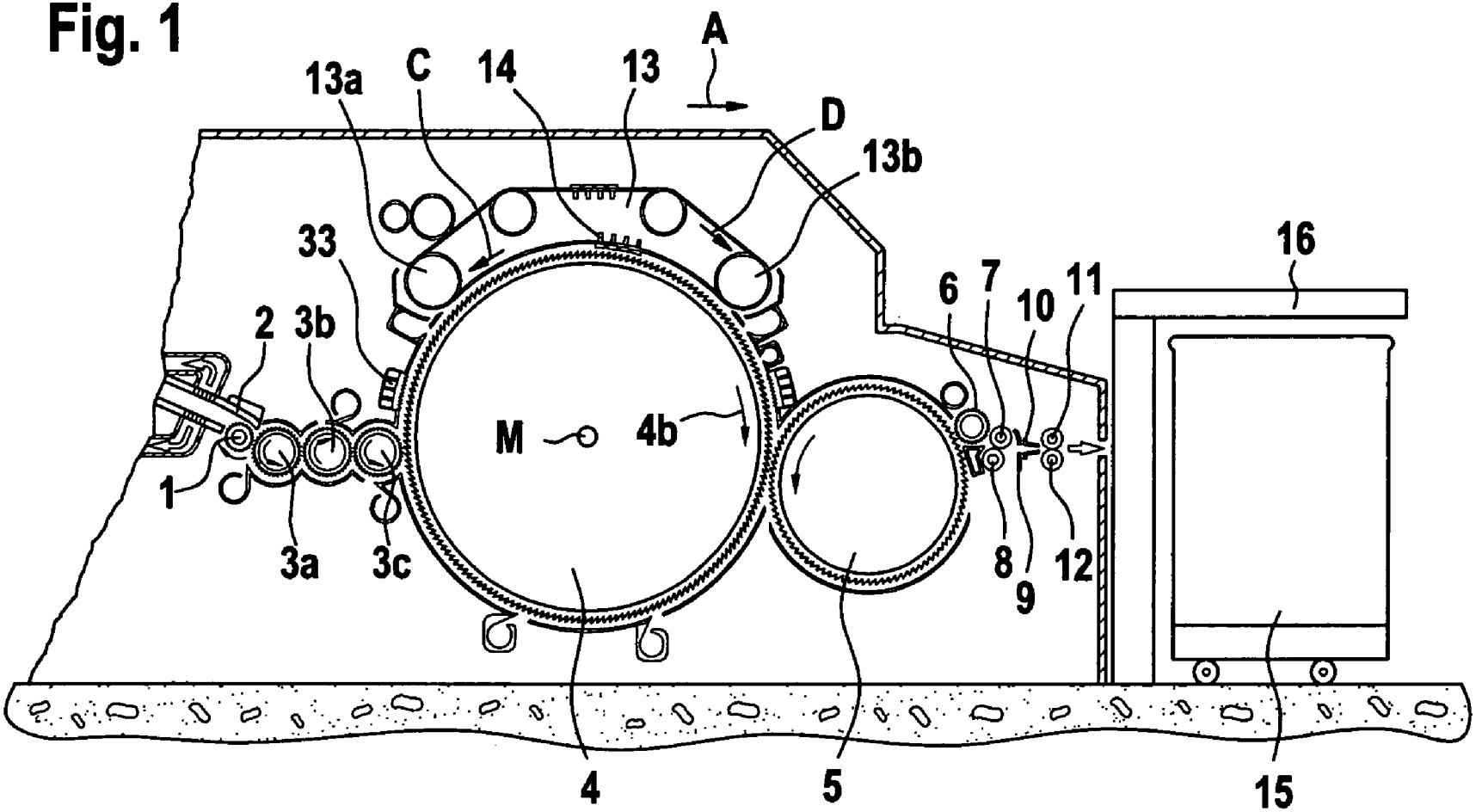
FIG. 1 is a schematic side view of a carding machine for an apparatus according to the invention.

With reference to FIG. 1, a carding machine, for example, a high-performance card DK 903 made by Trützschler GmbH & Co. KG of Mönchengladbach, Germany has a feed roller 1, feed table 2, licker-ins 3*a*, 3*b*, 3*c*, cylinder 4, doffer 5, stripping roller 6, squeezing rollers 7, 8, web-guide element 9, web funnel 10, take-off rollers 11, 12, revolving card flat assembly 13 with card flat bar guide rollers 13*a*, 13*b* and card flat bars 14, can 15 and can coiler 16. The directions of rotation of the rollers are shown by respective curved arrows. The letter M denotes the midpoint (axis) of the cylinder 4. The reference numeral 4 denotes the clothing and 4*b* denotes the direction of rotation of the cylinder 4. The letter C denotes the direction of rotation in the carding setting and the letter D the return transport direction of the card flat assembly.

Figure 2:
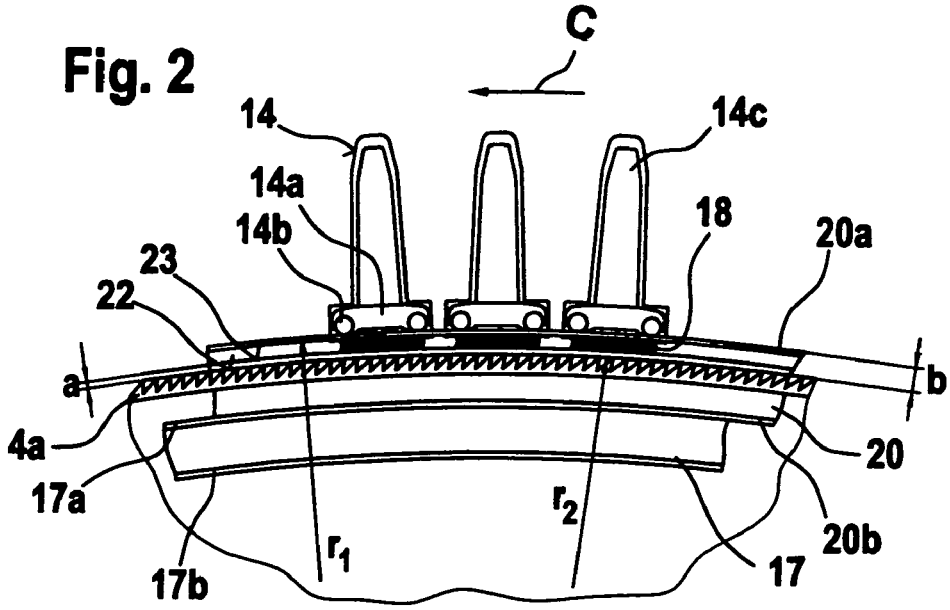
FIG. 2 is a side view of a revolving card top showing card flat bars and a fragment of the first slideway of a two-part slideway and a flexible bend.

Referring to FIG. 2, on each side of the carding machine, a flexible bend 17 having several adjusting screws is secured by means of screws laterally to the machine frame. The flexible bend 17 has a convex outer surface 17*a* and a lower surface 17*b*. Above the flexible bend 17, there is a first slideway 20, for example, of anti-friction plastics material, which has a convex outer surface 20*a* and a concave inner surface 20*b*. The second slideway 21 (see FIGS. 3*a*, 3*b*, 4*a*, 4*b*) is not shown. The concave inner surface 20*b* lies on the convex outer surface 17*a*. The card flat bars 14 have at both ends a respective card flat heel part 14*a*, secured to which in the axial direction are two steel pins 14*b* that slide on the convex outer surface 20 of the slideway 20 in the direction of arrow C. The card flat clothing 14*d* is mounted on the lower surface of the carrier element 14*c*. The reference number 23 denotes the tip circle of the card flat clothings 14*d*. On its circumference, the cylinder 4 has a cylinder clothing 4*a*, for example, saw-tooth clothing. The reference numeral 22 denotes the tip circle of the cylinder clothing 4*a*. The distance between the tip circle 23 and the tip circle 22 is denoted by the letter a, and is, for example, 2/1000". The distance between the convex outer surface 20*a* and the tip circle 22 is denoted by the letter b. The variable radius of the convex outer surface 20*a* is denoted by $r_1$ and the constant radius of the tip circle 22 is denoted by $r_2$. The radius $r_2$ intersects the mid-point M (see FIG. 1) of the cylinder 4. The reference numeral 14c denotes the card flat back.

Figure 3A:
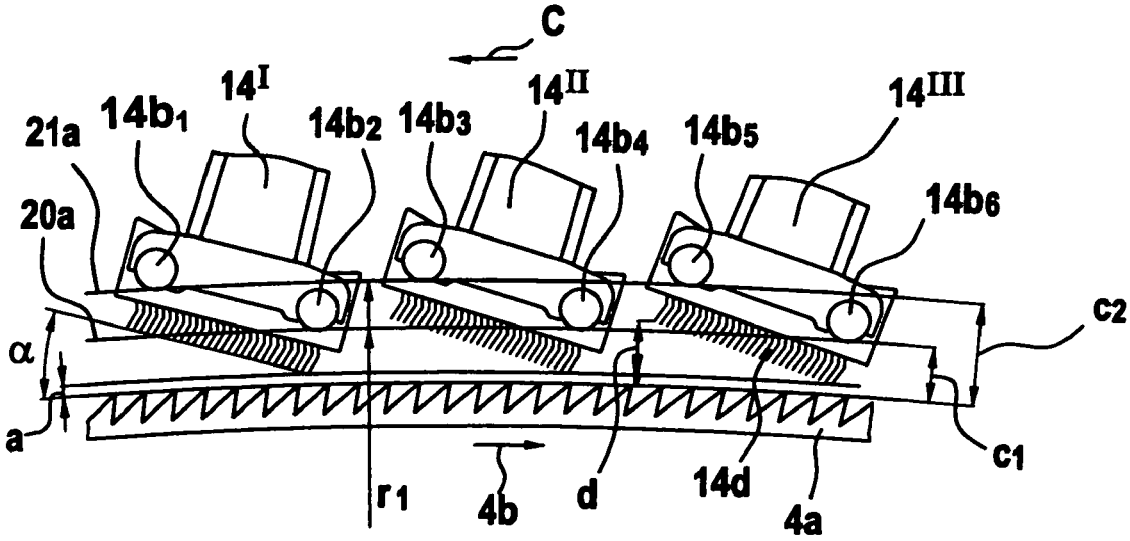
FIG. 3*a* is a side view of a revolving card top, showing schematically the adjustment of the angle between the card flat clothings and the cylinder clothing at the card flat outlet or fibre inlet (offset angle)
Figure 3B:
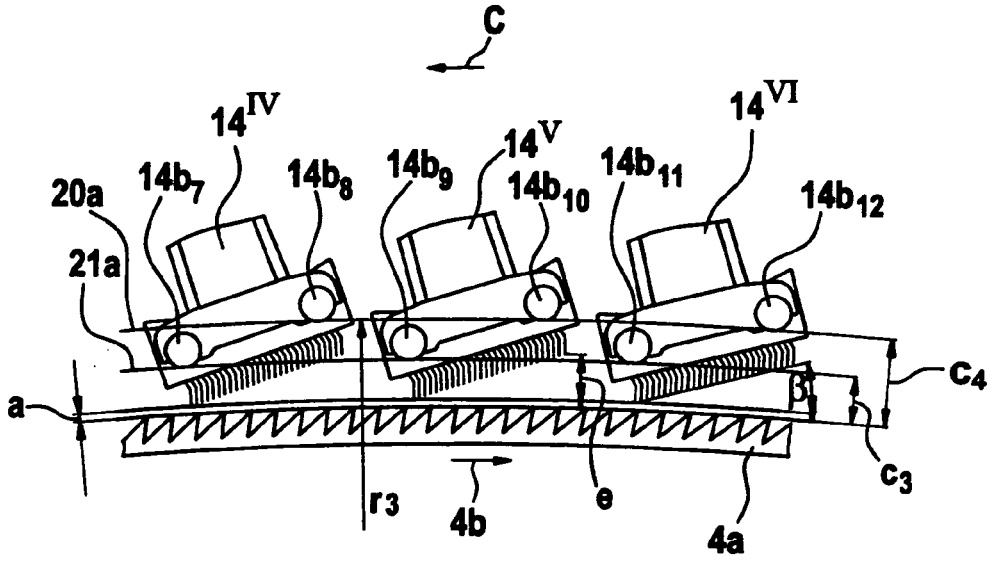
FIG. 3*b* is a side view of another part of the revolving card top of FIG. 3*a* showing schematically the adjustment of the angle between the card flat clothings and the cylinder clothing at the card flat inlet or fibre outlet (counter-gap)

FIGS. 3*a* and 3*b* show (to an exaggerated degree in the drawing) the changes in the angle α and β respectively subtended between successive card flat clothings 18*a*, 18*b*, 18*c* and the tangent to the cylinder clothing 4*a*. According to FIG. 3*a*, the pins $\mathbf{14}b_1$, $\mathbf{14}b_3$ and $\mathbf{14}b_5$ lie on the sliding-contact surface 21*a* of the second slideway 21 and the pins $\mathbf{14}b_2$, $\mathbf{14}b_4$ and $\mathbf{14}b_6$ lie on the sliding-contact surface 20*a* on the first slideway 20. The distance between the tip circle 22 of the cylinder clothing 4*a* and the sliding-contact surface 20*a* is denoted by the reference $c_1$ and the distance to the sliding-contact surface 21*a*by the reference $c_2$. The distance $c_2$ is larger than the distance $c_1$. The clothing 14*d* of the card flat bars $\mathbf{14}^{I}$, $\mathbf{14}^{II}$, $\mathbf{14}^{III}$ forms a respective acute angle a with the tangent to the cylinder clothing 4*a*, with the result that the carding nip narrows in the direction of rotation 4*b* of the cylinder 4. The distance between the clothing 14*d* and the cylinder clothing 4*a* is denoted at the entry of the carding nip by the letter d, and at the exit by the letter a, d being greater than a. The angle of inclination a is termed the so-called offset angle. The slow-running card flat bars $\mathbf{14}^{I}$, $\mathbf{14}^{II}$, $\mathbf{14}^{III}$ are located in the region of the card flat guide roller 13*a*, that is, in the region of the card flat exit or fibre intake.

Referring to FIG. 3*b*, the pins $\mathbf{14}b^{8}$, $\mathbf{14}b^{10}$, $\mathbf{14}b^{12}$ lie on the sliding-contact surface 20*a* of the first slideway 20 and the pins $\mathbf{14}b^{7}$, $\mathbf{14}b^{9}$ and $\mathbf{14}b^{11}$ lie on the sliding-contact surface 21*a* on the second slideway 21. The distance between the tip circle 22 of the cylinder clothing 4*a* and the sliding-contact surface 21*a* is denoted by the reference $c_3$ and the distance to the sliding-contact surface 20*a* by the reference $c_4$. The distance $c_4$ is larger than the distance $c_3$. The clothing 14*d* of the card flat bars $\mathbf{14}^{IV}$, $\mathbf{14}^{V}$, $\mathbf{14}^{VI}$ subtends a respective acute angle β with the tangent to the cylinder clothing 4*a*, with the result that the carding nip opens out in the direction of rotation 4*b* of the high-speed cylinder 4. The distance between the clothing 14*d* and the cylinder clothing 4*a* is denoted at the entry of the carding nip by the letter a, and at the exit by the letter e, e being greater than a. The angle of inclination β is termed the so-called counter-offset angle. The slow-running card flat bars $\mathbf{14}^{IV}$, $\mathbf{14}^{V}$, $\mathbf{14}^{VI}$ are located in the region of the card flat guide roller 13*b*, that is, in the region of the card flat entry or fibre outlet. FIGS. 3*a* and 3*b* serve to illustrate the adjustment of the offset angle and counter-offset angle. The pins 14*b* of identical diameters in FIGS. 3*a* and 3*b* can in practice instead be of the form corresponding to FIGS. 5*a* to 5*c*.

The angles α and β can be, for example, about 1°. The distance a at the narrowest point of the carding nip is for all card flat bars $\mathbf{14}^{I}$ to $\mathbf{14}^{VI}$ preferably the same or almost the same and can be, for example 3/1000".

Figure 4A:
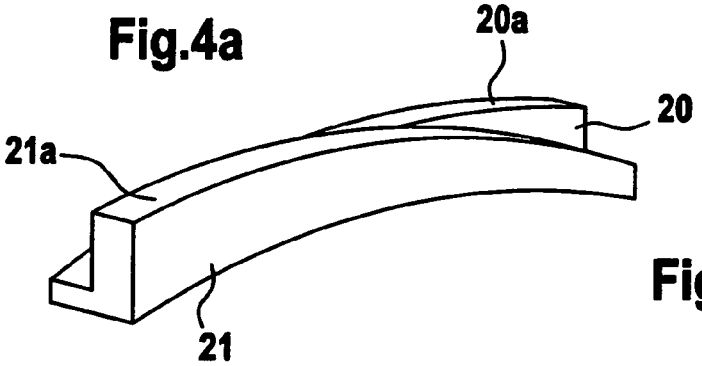
FIG. 4*a* is a perspective view of one construction of slide rail according to the invention.
Figure 4B:
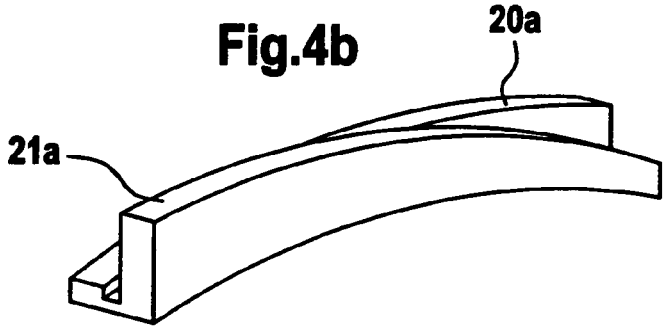
FIG. 4*b* is a perspective view of a second construction of slide rails.
Figure 4C:
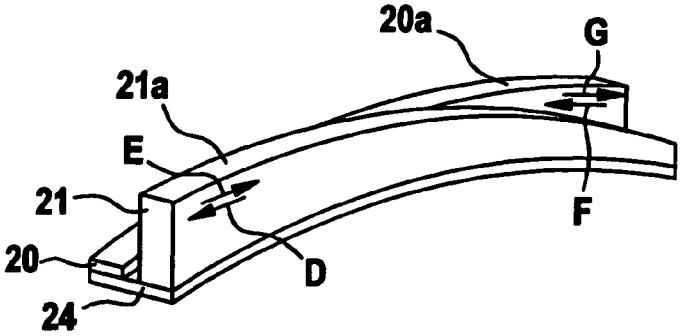
FIG. 4*c* is a perspective view of a third construction of slide rails.

In FIGS. 4*a* to 4*c* there are shown three illustrative forms of slideways suitable for use in the invention.

FIG. 4*a* shows two curved slideways 20 and 21, which consist, for example, of anti-friction plastics material and are flexible. The slideways 20, 21 are manufactured in one piece from a plastics material block, for example, by material-removing milling or similar processes. The slideways 20, 21 are formed without an intermediate space between them. FIG. 4*b* shows a one-piece construction similar to that of FIG. 4*a*, but in which between the slideways 20, 21 there is an intermediate space in the form of a longitudinal groove open at one side. The one-piece constructions shown in FIG. 4*a* and FIG. 4*b* are displaceable as a whole on the flexible bend 17 or on a carrier element 24 in the circumferential direction of the cylinder 4. Referring to FIG. 4*c*, the slideways 20 and 21 are arranged on the carrier element 24 and are individually longitudinally slidable in the direction of the curved arrows D, E and F, G respectively. The slideways 20 and 21 can also be arranged separately (in a manner not shown) side by side on the flexible bend 17 so as to be displaceable in direction D, E and F, G. The slideways 20, 21 can be arranged with or without an intermediate space between them so as to be displaceable.

Figure 4D:
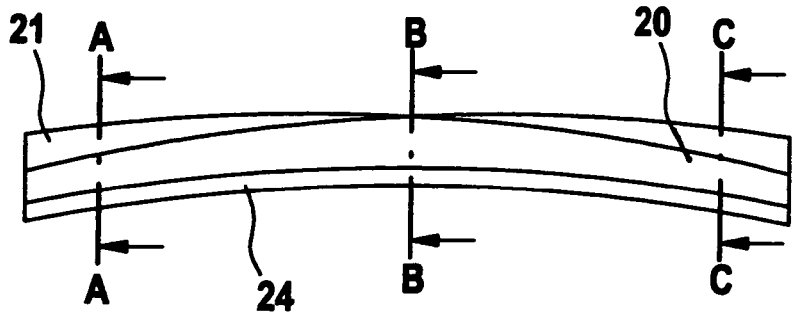
FIG. 4*d* is a side view of the slide rails of FIGS. 4*a* to 4*c;*
Figure 4E:
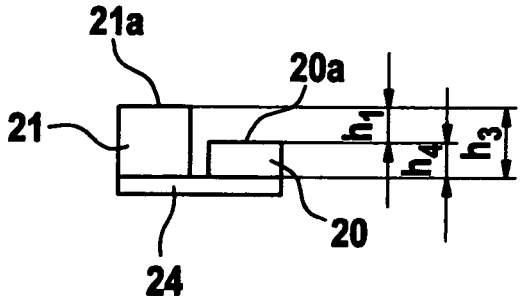
FIG. 4*e* is section A—A in accordance with FIG. 4*d;*
Figure 4F:
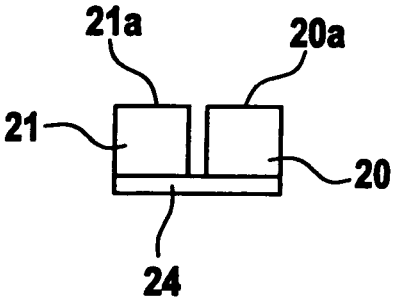
FIG. 4*f* is section B—B in accordance with FIG. 4*d;*
Figure 4G:
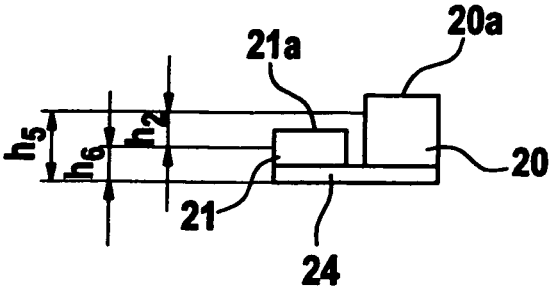
FIG. 4*g* is section C—C in accordance with FIG. 4*d;*

As shown in a perspective view in FIG. 4*a* to 4*b* and in side view in FIG. 4*d*, the sliding-contact surfaces 20*a*, 21*a* of the slideways 20, 21 are arranged so that they form an intersection point where they cross one another. As shown in FIG. 4*e*, in the region of the outlet of the card flat bar $\mathbf{14}^{I}$, a distance $h_1$ is present between the height $h_3$ of the sliding surface 21*a* and the height $h_4$ of the sliding surface 20*a*. As shown in FIG. 4*g*, in the region of the inlet of the card flat bar $\mathbf{14}^{VI}$, a distance $h_2$ is present between the height $h_5$ of the sliding surface 20*a* and the height $h_6$ of the sliding surface 21*a*. At the point at which the sliding-contact surfaces 20*a*, 21*a* shown in FIG. 4*d* intersect, FIG. 4*f* shows that there is no distance in the vertical direction between the sliding-contact surfaces 20*a*, 21*a*. In this way, the sliding-contact surfaces 20*a*, 21*a* of slideways 20, 21 are arranged relative to one another such that the distances $h_1$ and $h_2$ in the vertical direction between the sliding-contact surfaces 20*a*, 21*a* both increase and decrease. The distances $h_1$ and $h_2$ of the sliding-contact surfaces 20*a*, 21*a* of the slideways 20, 21 do not become strictly uniformly either smaller or larger with respect to one another.

Figure 5A:
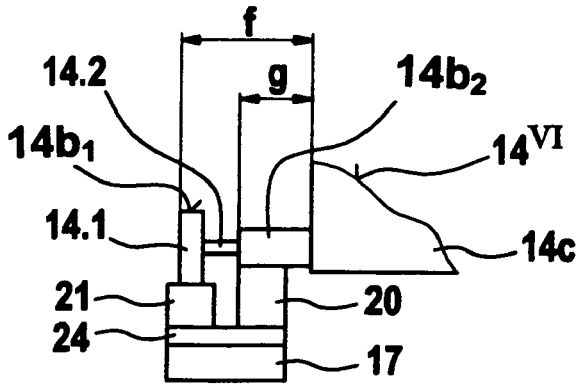
FIG. 5*a* is a front view of an embodiment with slide rails of different heights, in which the sliding elements in the card flat bar are arranged at the same height and have different diameters in the end region.
Figure 5B:
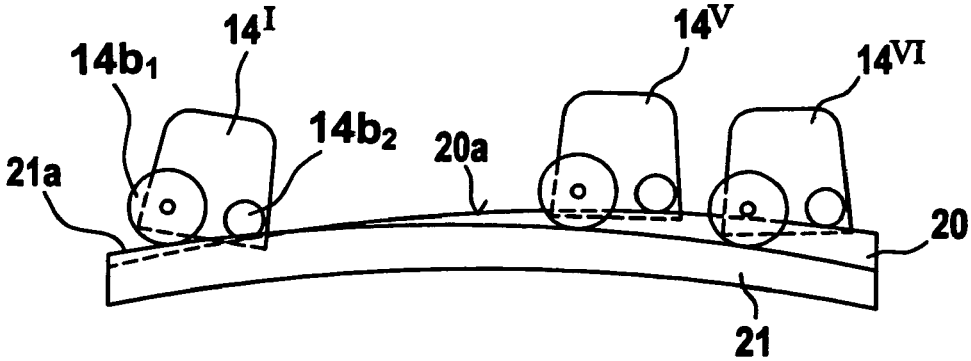
FIG. 5*b* is a side view of the construction corresponding to FIG. 5*a,* but without flexible bends and carrier element.
Figure 5C:
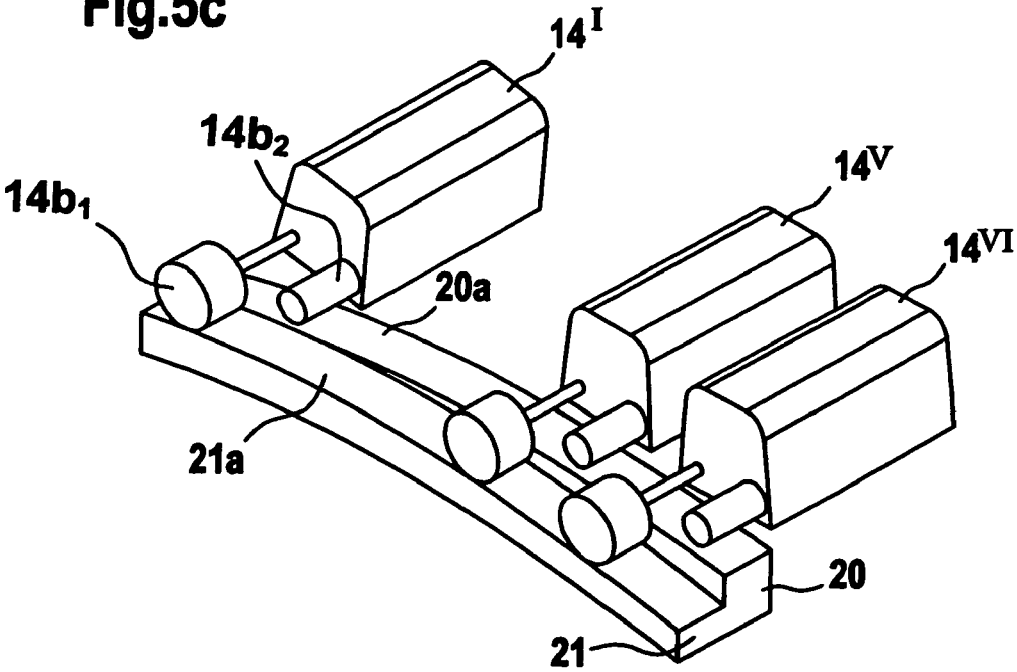
FIG. 5*c* is a perspective view of the construction according to FIG. 5*b;*

In the embodiment of FIGS. 5*a* to 5*c*, the card flat head consist of two sliding elements 14*b*$_1$, 14*b*$_2$, one end region of which is secured in apertures of the card flat heel part 14*a* (see DE-A-43 05 148). The sliding element 14*b*$_2$ is a cylindrical pin of stainless steel having a diameter of, for example, 6 mm; it projects beyond the end face of the card flat bar 14$^{VI}$ by distance g. The other sliding element 14*b*$_1$ consists of a cylindrical pin 14.2 having a diameter of, for example, 6 mm, at the free end of which a circular disc 14.1 of stainless steel having a diameter of, for example, 18 mm, is mounted and projects beyond the end face of the card flat bar 14$^{VI}$ by distance f. In place of the disc 14.1, the pin 14.2 can be angled, that is, bent towards the sliding-contact surface 21*a*. Distance f is larger than distance g. An elongate, flexible, curved carrier element 24 is arranged on the flexible bend 17, and can be displaced parallel to the flexible bend 17 and can be of wedge-form construction. On the upper side of the carrier element 24, the two curved slideways 20 and 21 of, for example, anti-friction plastics material, are arranged in a secure manner side by side. In operation, the sliding element 14*b*$_2$ slides on the sliding-contact surface 20*a* (see FIGS. 4*a* to 4*c*) of the slideway 20 and the disc 14.1 of the sliding element 14*b*$_1$ slides on the sliding-contact surface 21*a* (see FIGS. 4*a* to 4*c*) of the slideway 21.

Because the diameter $d_1$ of the disc 14.1 is larger than the diameter $d_2$ of the pin 14*b*$_2$ and the distance f is larger than the distance g, at the card flat entry the sliding element 14*b*$_1$ extends over the sliding-contact surface 20*a* to engage with the sliding-contact surface 21*a*arranged lower down. At the same time, the shorter sliding element 14*b*$_2$ engages with the sliding-contact surface 20*a* arranged higher up. In this way, the opening carding nip of angle β is formed. As the card flat bar 14$^{IV}$ slides in direction C, at the card flat exit the sliding element 14*b*$_2$, having slid beyond the intersection point of the two sliding-contact surfaces 20*a*, 21*a*, engages with the now lower sliding-contact surface 20*a* and the disc 14.1 engages with the higher sliding-contact surface 21*a*. By angling the card bars, the closing carding nip of angle α is formed at the card flat exit.

Figure 6A:
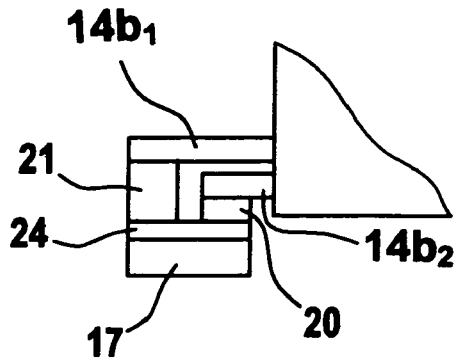
FIG. 6*a* is a front view of a further embodiment with sliding-contact surfaces of different heights, in which the sliding elements in the card flat bar are arranged at different heights and have the same diameter in the end region.
Figure 6B:
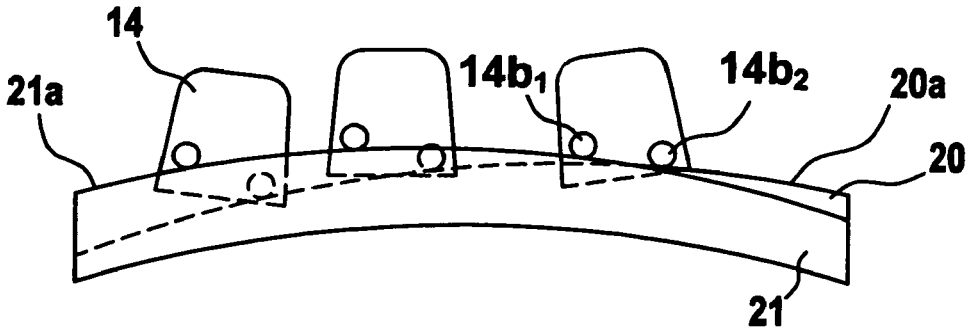
FIG. 6*b* is a side view of the construction corresponding to FIG. 6*a,* but without flexible bends and card flat backs.
Figure 6C:
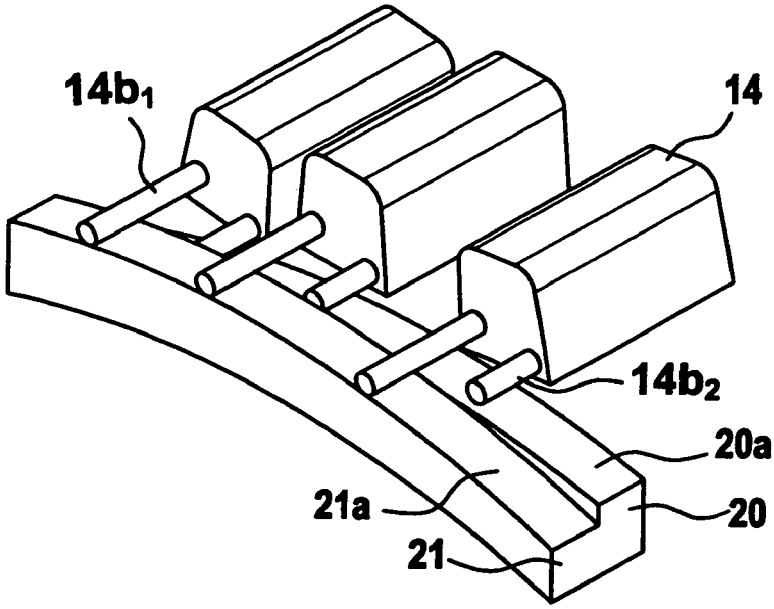
FIG. 6*c* is a perspective view of the construction according to FIG. 6*b;*

In the embodiment of FIGS. 6*a* to 6*c*, a further construction with sliding-contact surfaces 20*a*, 21*a* of different height is provided, in which the sliding elements 14*b* in the card flat bar 14 are arranged at different heights and in their end regions have the same diameter. The two sliding elements 14*b* on each card flat bar 14 are advantageously pins of stainless steel having a diameter of 6 mm. The intersection point between the sliding-contact surfaces 20*a*, 21*a* has been displaced asymmetrically towards the card flat entry.

Figure 7A:
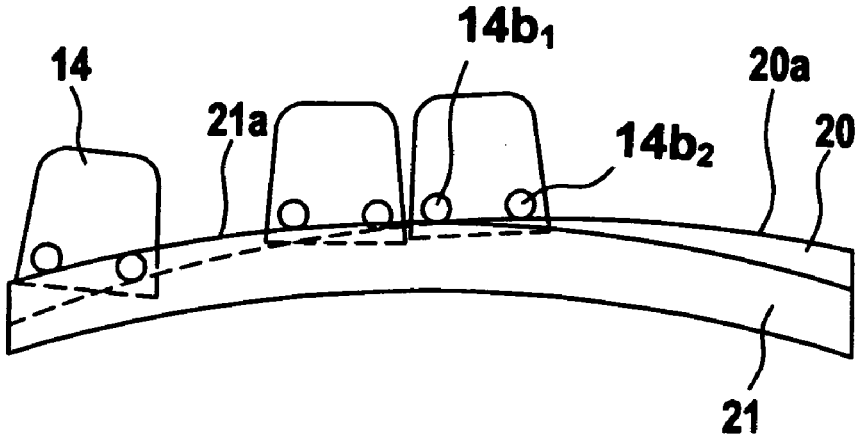
FIG. 7*a* is a side view of a further embodiment with slide rails of different heights, in which the sliding elements in the card-flat bar are arranged at the same height and have the same diameter in the end region.
Figure 7B:
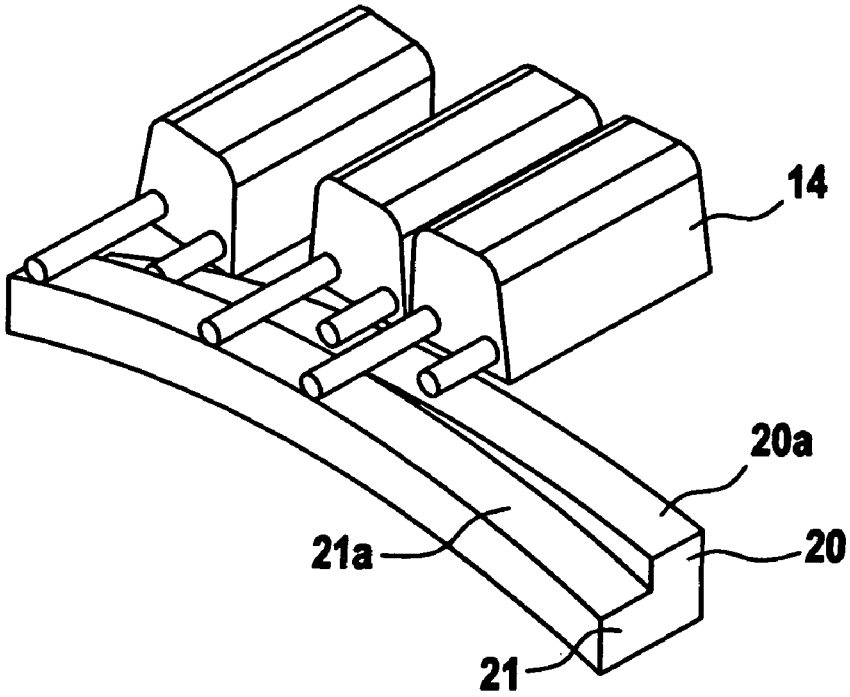
FIG. 7*b* is a perspective view of the construction corresponding to FIG. 7*a*.

In the embodiment of FIGS. 7*a*, 7*b*, yet a further construction has sliding-contact surfaces 20*a*, 21*a* of different height, in which the sliding elements 14*b* in the card flat bar are arranged at the same height and in, their end region are of the same diameter. The sliding elements 14*b* of this embodiment can also consist of stainless steel and have a diameter of 6 mm. In this construction, however, the intersection point between the two sliding-contact surfaces 20*a*, 21*a* is arranged asymmetrically towards the card flat exit.

Although the foregoing invention has been described in detail by way of illustration and example for purposes of clarity and understanding, it will be obvious that changes and modifications may be practised within the scope of the appended claims.

What is claimed is:

1. A carding machine comprising a carding cylinder and a revolving card flat assembly comprising revolving card flat bars, the machine further having a lateral slideway assembly comprising a first curved slideway and a second curved slideway and upon which ends of the card flat bars can slide with a part on said first slideway and a part on said second slideway, wherein said first slideway has a first sliding-contact surface and said second slideway has a second sliding-contact surface wherein said first sliding-contact surface is curved such that its distance from an axis of said cylinder increases in a circumferential direction about the axis, and said second sliding-contact surface is curved such that its distance from the axis decreases in the circumferential direction.

2. A carding machine according to claim 1, in which the second slideway is integrated in the first slideway.

3. A carding machine according to claim 1, in which at least one slideway is flexible.

4. A carding machine according to claim 1, in which at least one slideway is constructed to be displaceable in the circumferential direction in relation to the cylinder.

5. A carding machine according to claim 1, in which at least one slideway is exchangeable for another slideway having a different contour.

6. A carding machine according to claims 1, in which the two slideways are each separately displaceable relative to one another on one side of the cylinder.

7. A carding machine according to claim 6, in which displacement of the slideways can be effected during continuous operation.

8. A carding machine according to claim 1, in which a slideway assembly with first and second slideways is present on each side of the cylinder.

9. A carding machine according to claim 1, in which—viewed in the lateral direction—the first and second sliding-contact surfaces cross one another and, at the intersection point of the sliding-contact surfaces, the sliding-contact surfaces are at substantially the same height.

10. A carding machine according to claim 1, in which each card flat bar end comprises two sliding elements as said parts that contact respectively said first and second slideways.

11. A carding machine according to claim 10, in which the sliding elements are of different cross-section and/or diameter.

12. A carding machine according to claim 1, in which the card flat bars are arranged so as to rotate about an axis of rotation parallel to the cylinder axis.

13. A carding machine according to claim 1, in which the angle between the carding surface of at least one card flat bar and a respective tangent to the clothing of the cylinder is adjustable.

14. A carding machine according to claim 1, in which—viewed in the direction of rotation of the cylinder—at a fibre inlet region of the revolving card flat assembly at least one carding nip between a card flat bar and the cylinder closes.

15. A carding machine according to claim 1, in which—viewed in the direction of rotation of the cylinder—at a fibre outlet region of the revolving card flat assembly at least one carding nip between a card flat bar and the cylinder opens.

16. A carding machine according to claim 1, in which between the fibre inlet region and the fibre outlet region at least one card flat bar is at an angle of 0° relative to the cylinder.

17. A carding machine according to claim 1, in which the card flat bar can automatically assume different offset angle positions as it traverses the working region from card flat inlet to card flat exit.

18. A carding machine according to claim 17, in which the different offset angle is set independently of location.

19. A carding machine according to claim 17 or claim 18, in which the change in the offset angle is caused by height offset of the slide tracks relative to one another.

20. A carding machine according to claim 19, in which the height offset over the path of the revolving card-flat assembly is freely selectable.

21. A carding machine comprising a carding cylinder and a revolving card flat assembly comprising revolving card flat bars, the machine further having a lateral slideway assembly comprising a first curved slideway and a second curved slideway and upon which the card flat bars can slide with a first end part on said first slideway and a second end part on said second slideway, wherein said first slideway has a first sliding-contact surface and said second slideway has a second sliding-contact surface which is so located relative to the first sliding-contact surface that there are at least a convergent portion and a divergent portion of said slideway assembly in which in sliding-contact surfaces respectively converge and diverge vertically when viewed in a circumferential direction.

* * * * *